US011085099B2

(12) United States Patent
Yoshioka et al.

(10) Patent No.: US 11,085,099 B2
(45) **Date of Patent: *Aug. 10, 2021**

(54) HIGH-STRENGTH COLD-ROLLED STEEL SHEET

(71) Applicant: JFE Steel Corporation, Tokyo (JP)

(72) Inventors: Shimpei Yoshioka, Tokyo (JP); Yoshihiko Ono, Tokyo (JP); Hiroyuki Masuoka, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 20 days.

This patent is subject to a terminal disclaimer.

(21) Appl. No.: 15/999,603

(22) PCT Filed: Feb. 15, 2017

(86) PCT No.: PCT/JP2017/005466
§ 371 (c)(1),
(2) Date: Oct. 29, 2019

(87) PCT Pub. No.: WO2017/141952
PCT Pub. Date: Aug. 24, 2017

(65) Prior Publication Data

US 2020/0071784 A1 Mar. 5, 2020

(30) Foreign Application Priority Data

Feb. 18, 2016 (JP) ..... JP2016-028880

(51) Int. Cl.
*C22C 38/00* (2006.01)
*C22C 38/02* (2006.01)
(Continued)

(52) U.S. Cl.
CPC ..... *C21D 9/46* (2013.01); *C21D 6/002* (2013.01); *C21D 6/005* (2013.01); *C21D 6/007* (2013.01);
(Continued)

(58) Field of Classification Search
CPC ..... C21D 9/46; C21D 6/002; C21D 6/005; C21D 6/007; C21D 6/008; C21D 8/0205;
(Continued)

(56) References Cited

U.S. PATENT DOCUMENTS

2009/0014095 A1 1/2009 Mukai et al.
2013/0149526 A1* 6/2013 Masuoka ..... C22C 38/04 428/332

(Continued)

FOREIGN PATENT DOCUMENTS

CN 102959129 A 3/2013
CN 107429344 A 12/2017

(Continued)

OTHER PUBLICATIONS

The Extended European Search Report dated Dec. 11, 2018, of counterpart European Application No. 17753208.2.

(Continued)

*Primary Examiner* — Anthony J Zimmer
*Assistant Examiner* — Dean Mazzola
(74) *Attorney, Agent, or Firm* — DLA Piper LLP (US)

(57) ABSTRACT

A high-strength cold-rolled steel sheet has a composition that contains, in terms of mass %, C: 0.10% or more and 0.50% or less, Si: 1.0% or more and 3.0% or less, Mn: 1.0% or more and 2.5% or less, P: 0.05% or less, S: 0.02% or less, Al: 0.01% or more and 1.5% or less, N: 0.005% or less, Cu: 0.05% or more and 0.50% or less, and the balance being Fe and unavoidable impurities, wherein a proportion of a steel sheet surface covered with oxides mainly composed of Si is 1% or less, a proportion of the steel sheet surface covered with Fe oxides is 40% or less, $Cu_S/Cu_B$ is 4.0 or less, and a tensile strength is 1180 MPa or more, when $Cu_S$ denotes the Cu content in a steel sheet surface layer and $Cu_B$ denotes the Cu content in a base material.

17 Claims, 2 Drawing Sheets

(51) Int. Cl.

| | |
|---|---|
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/20*** | (2006.01) |
| ***C22C 38/38*** | (2006.01) |
| ***C21D 9/46*** | (2006.01) |
| ***C21D 6/00*** | (2006.01) |
| ***C21D 8/02*** | (2006.01) |
| ***C23G 1/08*** | (2006.01) |

(52) U.S. Cl.
CPC ..... *C21D 6/008* (2013.01); *C21D 8/0205* (2013.01); *C22C 38/001* (2013.01); *C22C 38/002* (2013.01); *C22C 38/005* (2013.01); *C22C 38/008* (2013.01); *C22C 38/02* (2013.01); *C22C 38/06* (2013.01); *C22C 38/10* (2013.01); *C22C 38/12* (2013.01); *C22C 38/14* (2013.01); *C22C 38/20* (2013.01); *C22C 38/38* (2013.01); *C23G 1/081* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 8/0236; C21D 2211/001; C21D 2211/002; C21D 2211/005; C21D 2211/008; C22C 38/04; C22C 38/001; C22C 38/002; C22C 38/005; C22C 38/008; C22C 38/02; C22C 38/06; C22C 38/10; C22C 38/12; C22C 38/14; C22C 38/20; C22C 38/38; C22C 38/16; C22C 38/18; C22C 38/22; C22C 38/24; C22C 38/26; C22C 38/28; C22C 38/30; C22C 38/32; C22C 38/36; C23G 1/02; C23G 1/081; C23G 1/083; C23G 1/085
See application file for complete search history.

(56) References Cited

U.S. PATENT DOCUMENTS

| | | | | |
|---|---|---|---|---|
| 2013/0149529 | A1* | 6/2013 | Masuoka et al. ..... | C23G 1/085 428/336 |
| 2014/0170439 | A1 | 6/2014 | Allain et al. | |
| 2014/0373980 | A1* | 12/2014 | Hayashi ..... | C21D 9/561 148/503 |
| 2015/0232977 | A1* | 8/2015 | Sato ..... | C22C 38/001 428/659 |
| 2015/0299834 | A1* | 10/2015 | Mizuta et al. ..... | C22C 38/58 |
| 2018/0305784 | A1* | 10/2018 | Fujimura et al. ..... | C23G 1/085 |
| 2020/0071784 | A1 | 3/2020 | Yoshioka et al. | |

FOREIGN PATENT DOCUMENTS

| | | | | |
|---|---|---|---|---|
| EP | 2612956 | A1 | | 7/2013 |
| EP | 3009527 | A1 | | 4/2016 |
| EP | 3272892 | A1 | | 1/2018 |
| GB | 2450066 | A | | 12/2008 |
| JP | 3545980 | B2 | | 7/2004 |
| JP | 4362318 | B2 | * | 11/2009 |
| JP | 2010-222668 | A | | 10/2010 |
| JP | 2011-231377 | A | | 11/2011 |
| JP | 2012-12642 | A | | 1/2012 |
| JP | 2012-132092 | A | | 7/2012 |
| JP | 2012-172183 | A | | 9/2012 |
| JP | 2013-124383 | A | | 6/2013 |
| JP | 2013-173976 | A | | 9/2013 |
| JP | 5729211 | B2 | | 6/2015 |
| JP | 2015-193907 | A | | 11/2015 |
| KR | 10-2008-0100835 | A | | 11/2008 |
| KR | 10-2014-0012167 | A | | 1/2014 |
| KR | 10-2016-0012205 | A | | 2/2016 |

OTHER PUBLICATIONS

Office Action dated Sep. 16, 2019, of counterpart Korean Application No. 10-2018-7023563, along with a Concise Statement of Relevance of Office Action in English.

Office Action dated Sep. 24, 2019, of counterpart Chinese Application No. 201780011764.2, along with a Concise Statement of Relevance of Office Action in English.

Notice of Allowance dated Mar. 5, 2020, of counterpart Korean Application No. 10-2018-7023563, along with an English translation.

Official Action dated Aug. 27, 2020, of related U.S. Appl. No. 16/077,266.

Official Action dated Dec. 8, 2020, of related U.S. Appl. No. 16/077,266.

* cited by examiner

HIGH-STRENGTH COLD-ROLLED STEEL SHEET

TECHNICAL FIELD

This disclosure relates to a high-strength cold-rolled steel sheet, in particular, a high-strength cold-rolled steel sheet that has a tensile strength of 1180 MPa or more and excellent delayed fracture resistance and chemical convertibility.

BACKGROUND

In recent years, weight-reduction and strengthening of car bodies are pursued as a backdrop for the need to reduce $CO_2$ emissions and improve collision safety. Today, the mainstream tensile strength of such steel sheets for automobiles is s 980 MPa grade. However, the steel sheets are increasingly required to achieve even higher strength and development of high-strength steel sheets having a tensile strength of 1180 MPa or more is needed. However, hydrogen from the operation environment may cause delayed fracture and increasing the strength of the steel sheet degrades ductility.

Moreover, since steel sheets for automobiles are painted before use, a chemical conversion treatment such as a phosphate treatment is performed as the preliminary process of painting. The chemical conversion treatment is one of the important processes to obtain corrosion resistance after painting and, thus, steel sheets for automobiles are also required to have excellent chemical convertibility.

Silicon (Si) is an element that causes solid-solution-strengthening of ferrite and refinement of carbides inside martensite and bainite to improve the ductility of steel at an equal strength. Since Si also suppresses generation of carbides, retained austenite, which contributes to ductility, can be easily obtained. Moreover, it is also known that Si causes refinement of boundary carbides in martensite and bainite, and thereby decreases the concentration of stress and strain near the grain boundaries and improves the delayed fracture resistance. Thus, many methods of producing high-strength steel sheets that utilize Si have been disclosed to date.

Japanese Unexamined Patent Application Publication No. 2012-12642 describes a steel sheet having a structure composed of ferrite and tempered martensite to which 1 to 3 mass % of Si is added, and having a tensile strength of 1320 MPa or more and excellent delayed fracture resistance.

One of the elements that improve the delayed fracture resistance is Cu. In Japanese Patent No. 3545980, Cu is added to improve the corrosion resistance of an electric resistance welded steel pipe prepared from a hot-rolled steel sheet and to significantly improve the delayed fracture resistance.

Japanese Patent No. 5729211 describes a steel sheet having excellent chemical convertibility, to which 0.5 to 3 mass % Si and 2 mass % or less Cu are added.

However, according to the manufacturing method described in JP '642, oxides mainly composed of Si are formed in a steel sheet surface layer in a continuous annealing line, and the chemical convertibility deteriorates. Moreover, merely increasing the Si content not only causes saturation of the effect, but also poses a problem of manufacturing such as an increased hot-rolling load.

Silicon (Si) is an element effective to obtain strength without significantly degrading the ductility of the steel sheet. Moreover, Si also causes refinement of carbides and improves delayed fracture resistance. It is presumed that since the steel composition described in JP '980 has a low Si content, the workability and the delayed fracture resistance are poor.

In JP '211, a surface of a continuously annealed steel sheet is pickled to remove the layer of oxides mainly composed of Si formed on the steel sheet surface layer during annealing to obtain excellent chemical convertibility despite a Si content of 0.5 mass % or more. However, the base iron dissolves due to this pickling, and Cu re-precipitates on the steel sheet surface. As a result, there arises a problem in that the dissolution reaction of iron during the chemical conversion treatment is suppressed at the sites where Cu has precipitated, and precipitation of chemical conversion crystals such as zinc phosphate is inhibited. For high-strength steel sheets exposed to a risk of delayed fracture by corrosion, the chemical convertibility requirement related to paint adhesion has become increasingly severe, and development of steel sheets that exhibit good chemical convertibility even under severe chemical conversion treatment conditions is desired.

It could therefore be helpful to provide a high-strength cold-rolled steel sheet having a tensile strength of 1180 MPa or more and excellent delayed fracture resistance and chemical convertibility.

SUMMARY

As mentioned above, oxides mainly composed of Si on the steel sheet surface are removed by pickling the surface of a continuously annealed steel sheet after cold-rolling a steel containing Cu and 0.5 mass % or more Si. However, good chemical convertibility is not obtained due to re-precipitation of Cu on the steel sheet surface.

We found that, when the layer of oxides mainly composed of Si on the steel sheet surface is removed by pickling after continuous annealing and $Cu_S/Cu_B$ is controlled to 4.0 or less (where $Cu_S$ denotes the Cu content in a steel sheet surface layer and $CU_B$ denotes the Cu content in a base material), deterioration of the chemical convertibility by Si and Cu can be prevented and the delayed fracture resistance can be improved.

We thus provide:

[1] A high-strength cold-rolled steel sheet comprising a composition that contains, in terms of mass %, C: 0.10% or more and 0.50% or less, Si: 1.0% or more and 3.0% or less, Mn: 1.0% or more and 2.5% or less, P: 0.05% or less, S: 0.02% or less, Al: 0.01% or more and 1.5% or less, N: 0.005% or less, Cu: 0.05% or more and 0.50% or less, and the balance being Fe and unavoidable impurities, wherein a proportion of a steel sheet surface covered with oxides mainly composed of Si is 1% or less, a proportion of the steel sheet surface covered with Fe oxides is 40% or less, $Cu_S/Cu_B$ is 4.0 or less, and a tensile strength is 1180 MPa or more, wherein $Cu_S$ denotes the Cu content in a steel sheet surface layer and $CU_B$ denotes the Cu content in a base material.

[2] The high-strength cold-rolled steel sheet described in [1], further comprising a steel sheet structure containing 40% or more and 100% or less of at least one selected from martensite and bainite in terms of volume fraction, 0% or more and 60% or less of ferrite in terms of volume fraction, and 0% or more and 20% or less of retained austenite.

[3] The high-strength cold-rolled steel sheet described in [1] or [2], in which [Si]/[Mn]>0.4 ([Si] denotes a Si content (mass %) and [Mn] denotes a Mn content (mass %)).

[4] The high-strength cold-rolled steel sheet described in any one of [1] to [3], in which the composition further contains, in terms of mass %, at least one selected from Nb: 0.2% or less, Ti: 0.2% or less, V: 0.5% or less, Mo: 0.3% or less, Cr: 1.0% or less, and B: 0.005% or less.

[5] The high-strength cold-rolled steel sheet described in any one of [1] to [4], in which the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

A high-strength cold-rolled steel sheet that has, in addition to a high tensile strength of 1180 MPa or more, excellent delayed fracture resistance and chemical convertibility can be obtained.

REFERENCE SIGNS LIST

Figure 1:
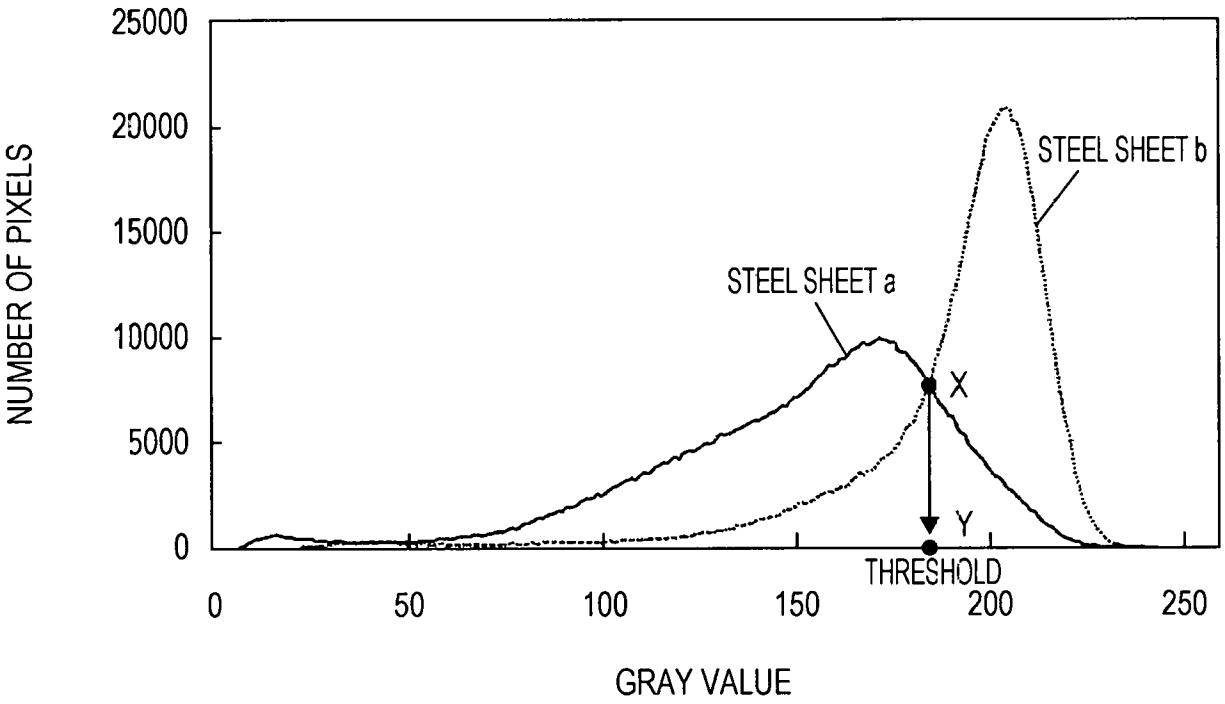
FIG. 1 is a histogram indicating the number of pixels plotted versus the gray value of reflection electron images.

1 test piece
2 bolt

DETAILED DESCRIPTION

In the description below, "%" indicates the content of the constituent element and means "mass %" unless otherwise noted. First, the composition of a cold-rolled steel sheet is described.

C: 0.10% or More and 0.50% or Less

Carbon (C) is an element effective in improving the strength-ductility balance of the steel sheet. It is difficult to obtain a tensile strength of 1180 MPa or more at a C content less than 0.10%. Meanwhile, at a C content exceeding 0.50%, coarse cementite precipitates, and hydrogen cracking occurs from the coarse cementite serving as the starting point. Thus, the C content is 0.10% or more and 0.50% or less. The lower limit is preferably 0.12% or more. The upper limit is preferably 0.30% or less.

Si: 1.0% or More and 3.0% or Less

Silicon (Si) is an element effective to obtain strength without significantly degrading the ductility of the steel sheet. At a Si content less than 1.0%, not only high strength and high workability cannot be achieved, but also coarsening of cementite cannot be suppressed and the delayed fracture resistance deteriorates. At a Si content exceeding 3.0%, the rolling workload during hot-rolling increases, oxide scale is generated on the steel sheet surface, and the chemical convertibility deteriorates. Thus, the Si content is 1.0% or more and 3.0% or less. The lower limit is preferably 1.2% or more. The upper limit is preferably 2.0% or less.

Mn: 1.0% or More and 2.5% or Less

Manganese (Mn) is an element that increases the strength of the steel sheet. It is difficult to obtain a tensile strength of 1180 MPa or more at a Mn content less than 1.0%. Meanwhile, the upper limit of the Mn content is 2.5% due to stability of weldability. Thus, the Mn content is 1.0% or more and 2.5% or less. The lower limit is preferably 1.5% or more. The upper limit is preferably 2.4% or less.

P: 0.05% or Less

Phosphorus (P) is an impurity element, and at a P content exceeding 0.05%, boundary embrittlement associated with P segregating in the austenite grain boundaries during casting deteriorates local ductility and thereby deteriorates the delayed fracture resistance of the steel sheet after molding. Thus, the P content is preferably reduced as much as possible, and the P content is 0.05% or less. Preferably, the P content is 0.02% or less. Considering the cost of production, the P content is preferably 0.001% or more.

S: 0.02% or Less

Sulfur (S) is present as MnS in the steel sheet and degrades the anti-crash property, strength, and delayed fracture resistance. Thus, the S content is preferably reduced as much as possible. Thus, the upper limit of the S content is 0.02% and is preferably 0.002% or less. More preferably, the S content is 0.001% or less. Considering the cost of production, the S content is preferably 0.0001% or more.

Al: 0.01% or More and 1.5% or Less

Aluminum (Al) itself forms oxides and thereby reduces the amounts of oxides of Si and the like. Thus, Al has an effect of improving the delayed fracture resistance. However, a significant effect is not obtained at an Al content less than 0.01%. When Al is excessively contained over 1.5%, Al bonds with N and forms nitrides. Since nitrides precipitate in austenite grain boundaries during casting and cause boundary embrittlement, the delayed fracture resistance deteriorates. Thus, the Al content is 0.01% or more and 1.5% or less. The lower limit is preferably 0.02% or more. The upper limit is preferably 0.05% or less.

N: 0.005% or Less

As mentioned above, N bonds with Al to form nitrides and deteriorates the delayed fracture resistance. Thus, the N content is preferably reduced as much as possible. Thus, the N content is to be 0.005% or less. Preferably, the N content is 0.003% or less. Considering the cost of production, the N content is preferably 0.0005% or more.

Cu: 0.05% or More and 0.50% or Less

Copper (Cu) suppresses dissolution of the steel sheet when exposed to a corrosive environment and thus has an effect of decreasing the amount of hydrogen penetrating into the steel sheet. This effect is small at a Cu content less than 0.05%. It becomes difficult to control the pickling conditions to obtain a desired Cu concentration distribution on the surface layer at a Cu content exceeding 0.50%. Thus, the Cu content is 0.05% or more and 0.50% or less. The lower limit is preferably 0.08% or more. The upper limit is preferably 0.3% or less.

At least one selected from Nb, Ti, V, Mo, Cr, and B may be contained in addition to the above-described elements to further improve properties.

Nb: 0.2% or Less

Niobium (Nb) forms fine Nb carbonitrides, makes the steel sheet structure finer, and improves the delayed fracture resistance by its hydrogen-trapping effect. Thus, Nb may be contained as needed. At a Nb content exceeding 0.2%, not only the structure refining effect is saturated, but also Nb in the presence of Ti forms coarse composite carbides with Ti, and this may deteriorate the strength-ductility balance and the delayed fracture resistance. Thus, if Nb is contained, the Nb content is preferably 0.2% or less. The Nb content is more preferably 0.1% or less and yet more preferably 0.05% or less. Although the lower limit is not particularly defined, the Nb content is preferably at least 0.004% to obtain the above-described effect.

Ti: 0.2% or Less

Titanium (Ti) forms carbides and thus has a steel sheet structure refining effect and a hydrogen trapping effect. Thus, Ti may be contained as needed. At a Ti content exceeding 0.2%, not only the structure refining effect is saturated, but also coarse TiN is formed, and Ti in the presence of Nb forms Ti—Nb composite carbides, and this may deteriorate the strength-ductility balance and the delayed fracture resistance. Thus, if Ti is contained, the Ti content is preferably 0.2% or less. The Ti content is more preferably 0.1% or less and yet more preferably 0.05% or less. Although the lower limit is not particularly defined, the Ti content is preferably at least 0.004% to obtain the above-described effect.

V: 0.5% or Less

Fine carbides formed by bonding of V and C strengthen the steel sheet through precipitation and serve as hydrogen trapping sites. Thus, V is effective in improving the delayed fracture resistance and may be contained as needed. Carbides precipitate excessively and the strength-ductility balance may deteriorate at a V content exceeding 0.5 mass %. Thus, the V content is preferably 0.5% or less. The V content is more preferably 0.1% or less and yet more preferably 0.05% or less. Although the lower limit is not particularly defined, the V content is preferably at least 0.004% to obtain the above-described effect.

Mo: 0.3% or Less

Molybdenum (Mo) is effective in improving hardenability of the steel sheet and also has a hydrogen trapping effect through fine precipitates. Thus, Mo may be contained as needed. At a Mo content exceeding 0.3%, not only the effect is saturated, but also formation of Mo oxides is accelerated on the steel sheet surface during continuous annealing, and the chemical convertibility of the steel sheet may be significantly degraded. Thus, the Mo content is preferably 0.3% or less. The Mo content is more preferably 0.1% or less and yet more preferably 0.05% or less. Although the lower limit is not particularly defined, the Mo content is preferably at least 0.005% to obtain the above-described effect.

Cr: 1.0% or Less

Chromium (Cr) is, as with Mo, effective in improving hardenability of the steel sheet and may be contained as needed. At a Cr content exceeding 1.0%, Cr oxides on the steel sheet surface may not be completely removed even when the pickling process is performed after continuous annealing and the chemical convertibility of the steel sheet may be significantly degraded. Thus, the Cr content is preferably 1.0% or less. The Cr content is more preferably 0.5% or less and yet more preferably 0.1% or less. Although the lower limit is not particularly defined, the Cr content is preferably at least 0.04% to obtain the above-described effect.

B: 0.005% or Less

Boron (B) segregates in the austenite grain boundaries during heating in continuous annealing, suppresses ferrite transformation and bainite transformation from austenite during cooling, and thereby facilitates formation of martensite. Thus, B is effective in strengthening the steel sheet and improves delayed fracture resistance through grain boundary strengthening. At a B content exceeding 0.005%, boron carbide, $Fe_{23}(C, B)_6$, is generated, and deterioration of work-ability and degradation of strength may occur. Thus, the B content is preferably 0.005% or less. More preferably, the B content is 0.003% or less. Although the lower limit is not particularly defined, the B content is preferably at least 0.0002% to obtain the above-described effect.

At least one selected from Sn, Sb, W, Co, Ca, and REM may be contained as long as the properties are not adversely affected.

Sn and Sb: Each 0.1% or Less

Tin (Sn) and antimony (Sb) each have an effect of suppressing surface oxidation, decarburization, and nitridation and thus may be contained as needed. However, the effect thereof is saturated at a content exceeding 0.1% for each element. Thus, if Sn and/or Sb is contained, the content is preferably 0.1% or less for each element. More preferably, the content thereof is 0.05% or less. Although the lower limit is not particularly defined, the content is preferably at least 0.001% to obtain the above-described effect.

W and Co: Each 0.1% or Less

Tungsten (W) and cobalt (Co) each have an effect of improving the properties of the steel sheet through sulfide morphology control, grain boundary strengthening, and solid solution strengthening, and may be contained as needed. However, excessive incorporation may deteriorate ductility through grain boundary segregation or the like. Thus, the content of each element is preferably 0.1% or less. More preferably, the content thereof is 0.05% or less for each element. Although the lower limit is not particularly defined, the content is preferably at least 0.01% for each element to obtain the above-described effect.

Ca and REM: Each 0.005% or Less

Calcium (Ca) and a rare earth metal (REM) both have an effect of improving ductility and delayed fracture resistance through sulfide morphology control. However, excessive incorporation may deteriorate ductility through grain boundary segregation or the like. Thus, the content of each element is preferably 0.005% or less. More preferably, the content thereof is 0.002% or less for each element. Although the lower limit is not particularly defined, the content is preferably at least 0.0002% for each element to obtain the above-described effect.

The balance other than the above-described elements is Fe and unavoidable impurities.

Proportion of steel sheet surface covered with oxides mainly composed of Si: 1% or less The chemical convertibility is significantly degraded when oxides mainly composed of Si are present on the steel sheet surface. Thus, the proportion of the steel sheet surface covered with oxides mainly composed of Si is 1% or less. Preferably, the proportion is 0%. It should be noted here that "mainly composed of Si" means that the Si atomic concentration ratio among the elements other than oxygen constituting the oxides is 70% or more. An example of the oxides mainly composed of Si is $SiO_2$. The proportion of the steel sheet surface covered with the oxides mainly composed of Si can be measured by the method of Examples described below. Proportion of steel sheet surface covered with Fe oxides: 40% or less When the proportion of the steel sheet surface covered with Fe oxides exceeds 85%, the dissolution reaction of iron in the chemical conversion treatment is inhibited, and growth of chemical conversion crystals such as zinc phosphate is suppressed. From the viewpoint of production cost reduction in recent years, the chemical conversion treatment solution has a low temperature, and the chemical conversion treatment conditions have become more severe. In this regard, it is not sufficient to set the proportion of the steel sheet surface covered with Fe oxides to 85% or less and the proportion is 40% or less. Preferably, the proportion is 35% or less. Although the lower limit is not particularly limited, the lower limit is typically 20% or more. The proportion of the steel sheet surface covered with the Fe oxides can be measured by the method of Examples described below. "Iron oxides" means iron-based oxides in which the iron atomic concentration ratio among the elements other than oxygen constituting the oxides is 30% or more.

Next, $Cu_S/Cu_B$, which is the most important feature is described.

$Cu_S/Cu_B$: 4.0 or Less ($Cu_S$ Denotes the Cu Content in a Steel Sheet Surface Layer and $Cu_B$ Denotes the Cu Content in a Base Material)

It is not sufficient to adjust the Si and Cu contents to be within the above-described ranges and, in pickling performed to remove the oxides mainly composed of Si, the Cu concentration distribution in the steel sheet surface layer needs to be controlled. In other words, the Cu content needs to be 0.05% or more and 0.50% or less, and $Cu_S/Cu_B$ needs to be 4.0 or less. Preferably, $Cu_S/Cu_B$ is 2.0 or more. The steel sheet surface layer refers to a region that spans 20 nm from the steel sheet surface in the sheet thickness direction, and the base material refers to a region other than the region that spans 1 μm from the steel sheet surface in the sheet thickness direction.

This Cu concentration distribution can be achieved by, for example, controlling the pickling weight loss within formula (1) in the pickling process after continuous annealing. The pickling weight loss is determined by the method of Examples described below:

$$WR \leq 33.25 \times \exp(-7.1 \times [\text{Cu } \%]) \quad (1)$$

where WR: pickling weight loss ($g/m^2$), and [Cu %]: Cu content in cold-rolled steel sheet (mass %).

The Cu concentration distribution in the steel sheet surface layer is evaluated by glow discharge spectroscopy (GDS). From a subject steel sheet, a 30 mm square sample is sheared, and the sample subjected to GDS analysis by using GDA 750 manufactured by Rigaku Corporation and an 8 minϕ anode under discharge conditions of DC: 50 mA and 2.9 hPa for a measurement time of 0 to 200 s at a sampling cycle of 0.1 s. The sputtering rate of the steel sheet is about 20 nm/s under these discharge conditions. The measurement lines used are Fe: 371 nm, Si: 288 nm, Mn: 403 nm, and O: 130 nm. Then, the ratio of the average intensity of Cu during the sputtering time of 0 to 1 s to the average intensity of Cu during the sputtering time of 50 to 100 s is determined. The value of this ratio can be assumed as the value of $Cu_S/Cu_B$, which is the ratio of the Cu content in the steel sheet surface layer ($Cu_S$) to the Cu content in the base material ($Cu_B$).

Tensile Strength: 1180 MPa or More

To increase the strength of the steel sheet and reduce the weight when the steel sheet is processed into a component, the tensile strength is 1180 MPa or more. Preferably, the tensile strength is 1320 MPa or more. The tensile strength is determined by the method of Examples described below.

[Si]/[Mn]>0.4 (where [Si] denotes the Si content (mass %) and [Mn] denotes the Mn content (mass %))

The balance between Si and Mn determines the generated amount of oxides mainly composed of Si and the amount of Si—Mn composite oxides. If one of the oxides is generated in an extremely large amount, the oxides on the steel sheet surface cannot be completely removed even when re-pickling is performed after pickling and the chemical convertibility may deteriorate. Thus, the ratio of the Si content to the Mn content is preferably defined. If the Mn content is excessively large compared to the Si content, in other words, if [Si]/[Mn]≤0.4, the oxides mainly composed of Si—Mn are excessively generated, and the desired chemical convertibility may not be obtained. Thus, preferably, [Si]/[Mn]>0.4. Since the maximum Si content is 3.0% and the minimum Mn content is 1.0%, [Si]/[Mn] is 3.0 or less.

The steel sheet structure may be controlled as below to further improve the properties. At least one selected from martensite and bainite: 40% or more and 100% or less in terms of volume fraction Martensite and bainite are structures effective to increase the strength of steel. If the volume fraction thereof is less than 40%, a tensile strength of 1180 MPa or more may not be obtained. Thus, at least one selected from martensite and bainite is preferably contained at a volume fraction of 40% or more and 100% or less. In the description of the structures of the cold-rolled steel sheet, "martensite" means tempered martensite.

Ferrite: 0% or More and 60% or Less in Terms of Volume Fraction

Ferrite, which contributes to ductility and improves workability of steel, may be included as needed. At a ferrite volume fraction exceeding 60%, the hardness of martensite or bainite must be significantly increased to obtain a tensile strength of 1180 MPa or more. As a result, stress and strain concentration occurs at the interface due to the difference in hardness among structures, and delayed fracture may be accelerated. Thus, 0% or more and 60% or less of ferrite is preferably contained in terms of volume fraction.

Retained Austenite: 0% or More and 20% or Less in Terms of Volume Fraction

Retained austenite improves the strength-ductility balance of the steel and may be generated as needed. However, retained austenite transforms into hard, un-tempered martensite once worked and, as described above, delayed fracture may be accelerated due to the stress and strain concentration at the interface caused by the difference in hardness among structures. Thus, 0% or more and 20% or less of retained austenite is preferably contained in terms of volume fraction. The upper limit is preferably less than 8% and more preferably 7% or less.

Other Phases

Other phases may be contained as the steel sheet structures in addition to martensite, bainite, ferrite, and retained austenite described above. For example, pearlite, as-quenched martensite, and the like may be contained. The volume fraction of other phases is preferably 5% or less to ensure the desired effects.

Next, a preferred method of producing a high-strength cold-rolled steel sheet is described. Preferably, a slab obtained by continuous casting is used as a steel, and a cold-rolled steel sheet is obtained through hot-rolling, finish-rolling, cooling, coiling, pickling, cold-rolling, continuous annealing, overaging, pickling, and re-pickling.

The processes from the steel making process to the cold-rolling process can be performed by traditional methods. The subsequent continuous annealing and pickling processing is preferably performed under the following conditions.

Continuous Annealing Conditions

In the description of the annealing conditions and the overaging conditions below, the temperature is the steel sheet surface temperature. At an annealing temperature lower than an $Ac_1$ point, austenite (transforms into martensite after quenching) needed to ensure the desired strength is not generated during annealing, and a tensile strength of 1180 MPa or more may not be obtained even when quenching is performed after annealing. Thus, the annealing temperature is preferably equal to or higher than the $Ac_1$ point. The annealing temperature is more preferably 800° C. or higher to stably obtain an austenite equilibrium area fraction of 40% or more. The $Ac_1$ point (° C.) is determined from formula (2):

$$Ac_1 = 723 - 10.7 \times [\text{Mn } \%] - 16.9 \times [\text{Ni } \%] + 29.1 \times [\text{Si } \%] + 16.9 \times [\text{Cr } \%] + 290 \times [\text{As } \%] + 6.38 \times [\text{W } \%] \quad (2).$$

In formula (2), [M] represents the content of an element (mass %), and 0 is indicated when the element is not contained.

Moreover, if the annealing temperature holding time is excessively short, the steel sheet structure is not sufficiently annealed and may form a nonuniform structure in which worked structures resulting from cold-rolling are present, and thereby ductility may be degraded. Meanwhile, an excessively long annealing temperature holding time is not preferable from the viewpoint of the production cost since the production time is extended. Thus, the annealing temperature holding time is preferably 30 to 1200 seconds. The lower limit of the holding time is particularly preferably 250 seconds or more. The upper limit is particularly preferably 600 seconds or less.

The processes from annealing to the overaging processing may be adjusted depending on the desirable structure.

If a ferrite-martensite (in some cases, bainite may also be included) multi-phase structure is the desirable structure, the following method may be used to produce the steel sheet, for example. Primary cooling is performed at an average cooling rate of 100° C./s or less from the annealing temperature to a primary cooling stop temperature equal to or higher than 600° C. The average cooling rate is more preferably 50° C./s or less. During the primary cooling from the annealing temperature, ferrite precipitates and it becomes possible to control the balance between strength and ductility. By setting the primary cooling stop temperature to be equal to or higher than the temperature at which ferrite starts to be generated, it becomes possible to obtain a uniform martensite single-phase structure through the secondary cooling described below. When the primary cooling stop temperature is lower than 600° C., large amounts of ferrite and pearlite are generated in the steel sheet structure, the strength may be rapidly degraded, and a tensile strength of 1180 MPa or more may not be obtained. The lower limit of the average cooling rate in primary cooling is preferably 5° C./s or more.

Following the primary cooling, secondary cooling is performed at an average cooling rate of 100° C./s or more to a secondary cooling stop temperature equal to or lower than 100° C. Secondary cooling is performed to transform austenite into martensite. At an average cooling rate of less than 100° C./s, austenite may transform into ferrite, bainite, or pearlite during cooling, and the desired structure may not be obtained. The secondary cooling preferably involves quenching by water quenching and the upper limit of the cooling rate is not set. When the cooling stop temperature is higher than 100° C., stable island-like retained austenite is generated, and the mechanical properties may deteriorate. Thus, the cooling stop temperature is preferably 100° C. or lower.

Following secondary cooling, an overaging process of performing re-heating to a temperature of 100° C. or higher and 300° C. or lower and holding the temperature for 120 to 1800 seconds at 100 to 300° C. to overage martensite is performed. Due to this overaging process, martensite is tempered, fine carbides are formed in martensite, and the delayed fracture resistance is improved. Precipitation of carbides may become insufficient when the overaging process is performed at a temperature lower than 100° C. Meanwhile, when tempering is performed at a temperature higher than 300° C., carbides coarsen and, as a result, strength may be significantly degraded and the delayed fracture resistance may deteriorate. When the holding time is less than 120 seconds, precipitation of carbides is insufficient and the effect of improving the delayed fracture resistance may not be expected. When the holding time exceeds 1800 seconds, coarsening of carbides proceeds, the strength is thereby degraded significantly and the delayed fracture resistance may deteriorate.

If the desirable structure is a multi-phase structure containing martensite, bainite, and retained austenite, the following method is preferably used to produce a steel sheet, for example. The structure may further contain ferrite. Primary cooling is performed at an average cooling rate of 3° C./s or more and 100° C./s or less to a primary cooling stop temperature of 150° C. or higher and 500° C. or lower. Subsequently, the temperature is held for 200 to 3000 seconds at 150° C. or higher and 500° C. or lower. Cooling is then performed to room temperature. The holding temperature needs not be the same temperature. For example, after cooling is performed to a temperature equal to or lower than the Ms point in the primary cooling, re-heating may be conducted to a temperature in the holding temperature range, and that temperature may be held. When the average cooling rate in the primary cooling is less than 3° C./s, large amounts of ferrite and pearlite are generated in the steel sheet structure, the strength is rapidly degraded, and a tensile strength of 1180 MPa or more may not be obtained. It becomes difficult to control the primary cooling stop temperature at an average cooling rate exceeding 100° C./s. Most of the steel sheet structure turns into martensite and a high strength is obtained when the primary cooling stop temperature is lower than 150° C. However, workability may be inferior to that of the multi-phase structure containing bainite and retained austenite. Meanwhile, at a primary cooling stop temperature higher than 500° C., a tensile strength of 1180 MPa or more may not be obtained. A sufficient amount of retained austenite may not be obtained when the holding time is less than 200 seconds or more than 3000 seconds. The Ms point (° C.) is determined from formula (3):

$$\text{Ms point}=565-31\times[\text{Mn }\%]-13\times[\text{Si }\%]-10\times[\text{Cr }\%]-18\times[\text{Ni }\%]-12\times[\text{Mo }\%]-[\text{Mo }\%]-600\times(1-\exp(-0.96\times[\text{C }\%])) \quad (3).$$

In formula (3), [M] represents the content of an element (mass %), and 0 is indicated when the element is not contained.

Pickling and Re-Pickling

The composition of the solution used in pickling is not particularly limited. For example, any one of nitric acid, hydrochloric acid, hydrofluoric acid, sulfuric acid, and a mixture of any two or more of the foregoing can be used. In re-pickling, a non-oxidizing acid is preferably used as the pickling solution unlike the pickling solution used in pickling.

The oxides mainly composed of Si and the Si—Mn composite oxides on the steel sheet surface deteriorate the chemical convertibility, but can be removed by pickling the steel sheet after the overaging process by using a strong acid such as a nitric acid having a concentration of more than 50 g/L, but not more than 200 g/L. However, as described above, to suppress the influence of Cu that has re-precipitated on the steel sheet surface layer and to further improve the chemical convertibility, the pickling weight loss (the total of pickling and re-pickling) is preferably controlled to be within formula (1). Moreover, Fe dissolving from the steel sheet surface by pickling forms Fe oxides, deposits and precipitates on the steel sheet surface, and covers the steel sheet surface. The chemical convertibility deteriorates as a result. Thus, to improve the chemical convertibility, re-pickling is preferably performed under appropriate conditions after the pickling described above to dissolve and remove the iron oxides that have precipitated on the steel sheet surface. For the reasons described above, in re-pickling, a non-oxidizing acid is preferably used as the pickling solution unlike the pickling solution used in pickling. The non-oxidizing acid is, for example, any one of hydrochloric acid, sulfuric acid, phosphoric acid, pyrophosphoric acid, formic acid, acetic acid, citric acid, hydrofluoric acid, oxalic acid, and a mixture of any two or more of the foregoing. For example, a mixed acid containing hydrochloric acid having a concentration of 0.1 to 50 g/L, sulfuric acid having a concentration of 0.1 to 150 g/L, hydrochloric acid having a concentration of 0.1 to 20 g/L, and sulfuric acid having a concentration of 0.1 to 60 g/L is suitable for use.

The pickling solution temperature in pickling and re-pickling is 30 to 68° C. In particular, when the temperature of re-pickling is 50° C. or higher, $Cu_S/Cu_B$ is 2.0 or more and the chemical convertibility is enhanced. $Cu_S/Cu_B$ exceeds 4.0 and the chemical convertibility is degraded when the temperature of re-pickling exceeds 68° C. The pickling process time for pickling and re-pickling can be appropriately selected and is preferably 2 to 40 seconds each.

EXAMPLES

Our steel sheets and methods will now be described specifically by way of examples. The technical scope of this disclosure is not limited by the examples.

Sample steels having compositions (the balance was Fe and unavoidable impurities) shown in Table 2 were each vacuum-melted and casted into a slab, and the slab is hot-rolled under the conditions shown in Table 3 to obtain a hot-rolled steel sheet (in Table 3, the slab heating temperature to the coiling temperature are the steel sheet surface temperatures). The hot-rolled steel sheet was subjected to a pickling process to remove surface scale and then cold-rolled. Subsequently, under the conditions shown in Table 3, continuous annealing and an overaging process were performed. Then, pickling and re-pickling were performed.

From the steel sheet obtained as above, a test piece was taken, and observation of the steel sheet structure, observation of the surface oxides, analysis of the Cu concentration distribution of the surface layer, tensile test, evaluation of the chemical convertibility, and evaluation of the delayed fracture resistance were conducted. The results are shown in Table 4.

The pickling weight loss was measured by cutting out a 50 mm×50 mm test piece from the steel sheet after the overaging process, measuring the weight of the test piece before and after pickling by using a precision balance, and determining the pickling weight loss from formula (4):

$$W=(W_1-W_2)/S \quad (4)$$

where W: pickling weight loss (g/m$^2$), $W_1$: weight before pickling (g), $W_2$: weight after pickling (g), and S: test piece surface area (m$^2$).

The steel sheet structure was observed by etching with nital a sheet thickness section taken parallel to the rolling direction and observing representative steel sheet structures in the etched section with a scanning electron microscope (SEM). A SEM image taken at a magnification of 2000× was analyzed to determine the area fraction of the ferrite region, and the value of the area fraction assumed to be the volume fraction of ferrite. In the sample where pearlite was generated, the volume fraction was determined from the SEM image in the same manner as above. The amount of the retained austenite was determined by observing the sheet surface. The sample was ground to a thickness equal to one fourth of the sheet thickness and then chemically polished, and the volume fraction of retained austenite was obtained by an X-ray diffraction method. The volume fractions of martensite and bainite were determined as the remainder of the total volume fraction of the ferrite, pearlite, and retained austenite.

The proportion of the steel sheet surface covered with oxides mainly composed of Si was determined by observing the steel sheet surface with a SEM at a magnification of 1000× and simultaneously analyzing the same area of view with EDX to identify the oxides mainly composed of Si. "Mainly composed of Si" means that the Si atomic concentration ratio among the elements other than oxygen constituting the oxides is 70% or more.

Fifteen straight lines extending in a horizontal direction and fifteen straight lines extending in a vertical direction were drawn at equal intervals on the obtained image, the presence or absence of the oxides mainly composed of Si was determined at the intersection of the horizontal and vertical straight lines, and the total number of intersections where the oxides mainly composed of Si were found was divided by the total number of intersections to determine the proportion of the surface covered. The average of five areas of view was assumed to be the proportion of the steel sheet surface covered with the oxides mainly composed of Si.

Proportion of the steel sheet surface covered with Fe oxides: By using an ultra-low accelerating voltage scanning electron microscope (ULV-SEM, ULTRA 55 manufactured by SEISS), the steel sheet surface was observed at an accelerating voltage of 2 kV, a working distance of 3.0 mm, and a magnification of 1000× in five areas of view, and reflection electron images were obtained by spectroscopy using an energy dispersive X-ray spectrometer (EDX, NSS312E manufactured by Thermo Fisher). The reflection electron images were processed with binary codes to measure the area fraction of the black portions, and the average of five areas of view was calculated and assumed to be the proportion of the steel sheet surface covered with Fe oxides.

The threshold for binarization will now be described.

A steel containing C: 0.14 mass %, Si: 1.7 mass %, Mn: 1.3 mass %, P: 0.02 mass %, S: 0.002 mass %, Al: 0.035 mass %, and the balance being Fe and unavoidable impurities was refined through a typical smelting process involving a converter process, a degassing process and the like, and continuously cast into a slab. Next, the slab was re-heated to 1150° C., then hot-rolled at a finishing delivery temperature of 850° C., and coiled at 550° C. to prepare a hot-rolled steel sheet having a sheet thickness of 3.2 mm. The hot-rolled steel sheet was pickled to remove the scale, and cold-rolled into a cold-rolled steel sheet having a sheet thickness of 1.8 mm. Next, the cold-rolled steel sheet was subjected to continuous annealing in which the cold-rolled steel sheet was heated to a soaking temperature of 750° C., held for 30 seconds, then cooled at 20° C./s from the soaking temperature to a cooling stop temperature of 400° C., and held at a temperature in the range of the cooling stop temperature for 100 seconds. Subsequently, pickling and re-pickling were performed under the conditions shown in Table 1, and the resulting sheet was rinsed with water, dried, and subjected to skinpass rolling at 0.7% to obtain two types of cold-rolled steel sheets, No. a and No. b, having different amounts of iron oxides on the steel sheet surface. Next, the cold-rolled steel sheet of No. a was assumed to be a standard sample with a high iron oxide content, the cold-rolled steel sheet of No. b was assumed to be a standard sample with a low iron oxide content, and reflection electron images were obtained under the above-described conditions from each of the steel sheets.

FIG. 1 is a histogram indicating the number of pixels plotted versus the gray value (the parameter value indicating the hue between white and black) of the reflection electron images. The gray value (point Y) at the intersection (point X) of the histograms of No. a and No. b shown in FIG. 1 was assumed to be the threshold, and the area of a portion with gray values equal to or lower than the threshold was assumed to be the proportion of the surface covered with iron oxides. When the proportion of the surface covered with iron oxides was calculated for each of the steel sheets of No. a and No. b by using the threshold, the result was 85.3% for the steel sheet No. a, and 25.8% for the steel sheet No. b.

The Cu concentration distribution in the surface layer was determined by GDS analysis under the analytic conditions described above.

In the tensile test, a JIS No. 5 test piece (gauge length: 50 mm, width of parallel part: 25 mm) was cut out such that the longitudinal direction was the direction perpendicular to the rolling direction in the steel sheet surface, and the test was conducted on the test piece in accordance with JIS Z 2241 at a strain rate of $3.3\times10^{-3}$ $s^{-1}$. Samples with a tensile strength of 1180 MPa or more were assumed to be satisfactory.

For evaluation of the chemical convertibility, chemical conversion treatment was performed under the standard conditions described below by using a degreasing agent: SURFCLEANER EC90, a surface adjustor: 5N-10, and a chemical conversion treatment agent: SURFDINE EC1000 manufactured by NIPPON PAINT Co., Ltd. so that the chemical conversion treatment coating weight was 1.7 to 3.0 $g/m^2$.

Standard Conditions

Degreasing process: process temperature: 45° C., processing time: 120 seconds Surface adjusting process: pH 8.5, processing temperature: room temperature, processing time: 30 seconds Chemical conversion treatment process: temperature of chemical conversion treatment agent: 40° C., processing time: 90 seconds The steel sheet surface after the chemical conversion treatment was observed with a SEM at a magnification of 500× for five areas of view, and the samples in which an area fraction of chemical conversion crystals accounted for 95% or more in all of the five areas of view were evaluated as having satisfactory ("A") chemical convertibility, the samples in which an area fraction of chemical conversion crystals accounted for 90% or more in all of the five areas of view were evaluated as having fair ("B") chemical convertibility, and the samples in which an area fraction of without chemical conversion crystals accounted for exceeding 10% at least in one area of view were evaluated as having poor ("F") chemical convertibility.

Figure 2:
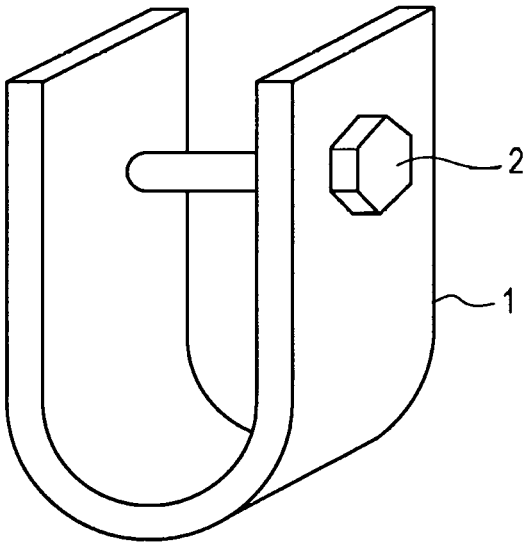
FIG. 2 is a diagram illustrating the state in which stress is applied in evaluating the delayed fracture resistance.

The delayed fracture resistance was evaluated through an immersion test. The steel sheet was cut to 35 mm×105 mm so that the longitudinal direction was the direction perpendicular to the rolling direction, and the end surfaces were ground to prepare a 30 mm×100 mm test piece. The test piece was subjected to 180° bending by using a punch having a tip with a radius of curvature of 10 mm such that the bent ridge line was parallel to the rolling direction. Then, as shown in FIG. 2, a bolt 2 was tightened so that the inner space of a test piece 1 was 10 mm to apply stress. The test piece in a stressed state was immersed in a 25° C., pH 1 hydrochloric acid, and the time taken until fracture was measured until 100 hours at most. The samples with a fracture time of less than 40 hours were evaluated as "F," the samples with a fracture time of 40 hours or more and less than 100 hours were evaluated as "A," and the samples that did not fracture for 100 hours were evaluated as "AA." The samples with a fracture time of 40 hours or more were evaluated as having excellent delayed fracture resistance.

TABLE 1

| | Pickling conditions | | | Re-pickling conditions | | | Proportion |
|---|---|---|---|---|---|---|---|
| Steel sheet | Acid concentration (g/l) | Temperature (° C.) | Processing time (sec) | Acid concentration (g/l) | Temperature (° C.) | Processing time (sec) | of surface covered with Fe oxides |
| a | Nitric acid: 250 + hydrochloric acid: 25 | 40 | 10 | — | — | — | 85 |
| b | Nitric acid: 150 + hydrochloric acid: 15 | 40 | 10 | Hydrochloric acid: 10 | 40 | 30 | 26 |

TABLE 2

| Type of | Composition (mass %) | | | | | | | | | | | | | | | $Ac_1$ | | [Si %]/ |
|---|---|---|---|---|---|---|---|---|---|---|---|---|---|---|---|---|---|---|
| steel | C | Si | Mn | P | S | Al | N | Cu | Nb | Ti | V | Mo | Cr | B | Others | (° C.) | Remarks | [Mn %] |
| A | 0.12 | 1.5 | 2.0 | 0.01 | 0.0009 | 0.033 | 0.0044 | 0.18 | 0 | 0 | 0 | 0 | 0 | 0 | 0 | 746 | Invention steel | 0.8 |
| B | 0.28 | 1.2 | 1.9 | 0.01 | 0.0008 | 0.031 | 0.0046 | 0.24 | 0 | 0 | 0 | 0 | 0 | 0 | 0 | 738 | Invention steel | 0.6 |
| C | 0.16 | 1.0 | 2.1 | 0.01 | 0.0005 | 0.030 | 0.0043 | 0.45 | 0 | 0 | 0 | 0 | 0 | 0 | 0 | 730 | Invention steel | 0.5 |
| D | 0.17 | 2.0 | 2.2 | 0.01 | 0.0010 | 0.032 | 0.0040 | 0.08 | 0 | 0 | 0 | 0 | 0 | 0 | 0 | 758 | Invention steel | 0.9 |
| E | 0.17 | 1.6 | 2.1 | 0.01 | 0.0007 | 0.028 | 0.0038 | 0.10 | 0 | 0 | 0 | 0 | 0 | 0 | 0 | 747 | Invention steel | 0.8 |
| F | 0.20 | 1.3 | 2.2 | 0.01 | 0.0009 | 0.029 | 0.0030 | 0.16 | 0.015 | 0 | 0 | 0 | 0 | 0 | 0 | 737 | Invention steel | 0.6 |
| G | 0.16 | 1.4 | 2.1 | 0.01 | 0.0012 | 0.029 | 0.0042 | 0.18 | 0 | 0.05 | 0 | 0 | 0 | 0 | 0 | 742 | Invention steel | 0.7 |
| H | 0.20 | 1.4 | 1.7 | 0.01 | 0.0011 | 0.029 | 0.0038 | 0.20 | 0 | 0 | 0.15 | 0 | 0 | 0 | 0 | 746 | Invention steel | 0.8 |

TABLE 2-continued

| Type of steel | Composition (mass %) C | Si | Mn | P | S | Al | N | Cu | Nb | Ti | V | Mo | Cr | B | Others | $Ac_1$ (° C.) | Remarks | [Si %]/[Mn %] |
|---|---|---|---|---|---|---|---|---|---|---|---|---|---|---|---|---|---|---|
| I | 0.21 | 1.4 | 2.4 | 0.01 | 0.0008 | 0.020 | 0.0030 | 0.22 | 0 | 0 | 0 | 0.1 | 0 | 0 | 0 | 738 | Invention steel | 0.6 |
| J | 0.19 | 1.2 | 2.4 | 0.01 | 0.0009 | 0.029 | 0.0044 | 0.19 | 0 | 0 | 0 | 0 | 0.2 | 0 | 0 | 736 | Invention steel | 0.5 |
| K | 0.20 | 1.5 | 2.4 | 0.01 | 0.0008 | 0.029 | 0.0030 | 0.17 | 0 | 0 | 0 | 0 | 0 | 0.004 | 0 | 741 | Invention steel | 0.6 |
| L | 0.21 | 1.3 | 2.4 | 0.01 | 0.0007 | 0.020 | 0.0042 | 0.20 | 0 | 0 | 0 | 0 | 0 | 0 | Sn: 0.002, Sb: 0.002 W: 0.015, Co: 0.018 | 735 | Invention steel | 0.5 |
| M | 0.20 | 1.7 | 2.3 | 0.01 | 0.0008 | 0.029 | 0.0042 | 0.15 | 0 | 0 | 0 | 0 | 0 | 0 | Ca: 0.001, REM: 0.0005 | 747 | Invention steel | 0.7 |
| N | 0.20 | 1.7 | 2.4 | 0.01 | 0.0007 | 0.030 | 0.0040 | 0.14 | 0 | 0 | 0 | 0 | 0 | 0 | 0 | 747 | Invention steel | 0.7 |
| O | 0.09 | 1.4 | 1.7 | 0.01 | 0.0010 | 0.027 | 0.0040 | 0.16 | 0 | 0 | 0 | 0 | 0 | 0 | 0 | 745 | Comparative steel | 0.8 |
| P | 0.56 | 1.5 | 1.7 | 0.01 | 0.0015 | 0.029 | 0.0038 | 0.18 | 0 | 0 | 0 | 0 | 0 | 0 | 0 | 749 | Comparative steel | 0.9 |
| Q | 0.16 | 0.4 | 2.3 | 0.01 | 0.0011 | 0.031 | 0.0042 | 0.12 | 0 | 0 | 0 | 0 | 0 | 0 | 0 | 710 | Comparative steel | 0.2 |
| R | 0.16 | 3.4 | 1.9 | 0.01 | 0.0012 | 0.031 | 0.0046 | 0.11 | 0 | 0 | 0 | 0 | 0 | 0 | 0 | 801 | Comparative steel | 1.8 |
| S | 0.15 | 1.7 | 0.7 | 0.01 | 0.0016 | 0.030 | 0.0034 | 0.13 | 0 | 0 | 0 | 0 | 0 | 0 | 0 | 764 | Comparative steel | 2.4 |
| T | 0.17 | 1.4 | 2.0 | 0.01 | 0.0009 | 0.029 | 0.0038 | 0.03 | 0 | 0 | 0 | 0 | 0 | 0 | 0 | 741 | Comparative steel | 0.7 |
| U | 0.16 | 1.5 | 2.1 | 0.01 | 0.0011 | 0.032 | 0.0040 | 0.55 | 0 | 0 | 0 | 0 | 0 | 0 | 0 | 744 | Comparative steel | 0.7 |

* 0 indicates that the component was not added. The conditions outside our range are shaded.

TABLE 3

| No. | Steel type | Hot-rolling process: Slab heating temperature (° C.) | Finish rolling temperature (° C.) | Coiling temperature (° C.) | Annealing process: Annealing temperature (° C.) | Holding time (sec) | Primary cooling average cooling rate (° C./sec) | Primary cooling stop temperature (° C.) | Secondary cooling average cooling rate (° C./sec) | Secondary cooling stop temperature (° C.) |
|---|---|---|---|---|---|---|---|---|---|---|
| 1 | A | 1250 | 900 | 580 | 830 | 600 | 10 | 700 | 902 | 24 |
| 2 | B | 1250 | 900 | 580 | 830 | 600 | 10 | 730 | 921 | 26 |
| 3 | C | 1250 | 900 | 580 | 830 | 600 | 11 | 700 | 883 | 25 |
| 4 | D | 1250 | 900 | 580 | 830 | 600 | 10 | 700 | 897 | 25 |
| 5 | E | 1250 | 900 | 580 | 830 | 600 | 10 | 720 | 911 | 26 |
| 6 | F | 1250 | 900 | 580 | 830 | 600 | 10 | 720 | 908 | 25 |
| 7 | G | 1250 | 900 | 580 | 830 | 600 | 11 | 700 | 904 | 25 |
| 8 | H | 1250 | 900 | 580 | 830 | 600 | 10 | 700 | 901 | 25 |
| 9 | I | 1250 | 900 | 580 | 830 | 600 | 9 | 700 | 905 | 26 |
| 10 | J | 1250 | 900 | 580 | 830 | 600 | 11 | 700 | 897 | 25 |
| 11 | K | 1250 | 900 | 580 | 830 | 600 | 10 | 700 | 901 | 25 |
| 12 | L | 1250 | 900 | 580 | 830 | 600 | 10 | 700 | 893 | 24 |
| 13 | M | 1250 | 900 | 580 | 830 | 600 | 12 | 700 | 895 | 25 |
| 14 | N | 1250 | 900 | 580 | 830 | 600 | 20 | 200 | — | — |
| 15 | O | 1250 | 900 | 580 | 830 | 600 | 10 | 700 | 889 | 25 |
| 16 | P | 1250 | 900 | 580 | 830 | 600 | 10 | 700 | 906 | 25 |
| 17 | Q | 1250 | 900 | 580 | 830 | 600 | 11 | 700 | 903 | 25 |
| 18 | R | 1250 | 900 | 580 | 830 | 600 | 11 | 700 | 903 | 25 |
| 19 | S | 1250 | 900 | 580 | 830 | 600 | 11 | 700 | 931 | 25 |
| 20 | T | 1250 | 900 | 580 | 830 | 600 | 9 | 700 | 782 | 25 |
| 21 | U | 1250 | 900 | 580 | 830 | 600 | 10 | 700 | 925 | 25 |
| 22 | E | 1250 | 900 | 580 | 700 | 600 | 10 | 650 | 902 | 24 |

TABLE 3-continued

| | Overaging process | | Pickling conditions | | | Re-pickling conditions | | | Pickling |
|---|---|---|---|---|---|---|---|---|---|
| No. | Overaging temperature (° C.) | Holding time (sec) | Acid concentration (g/l) | Temperature (° C.) | Processing time (sec) | Acid concentration (g/l) | Temperature (° C.) | Processing time (sec) | weight loss (g/m$^2$) |
| 1 | 200 | 600 | nitric acid: | 40 | 10 | hydrochloric | 50 | 10 | 8.7 |
| 2 | 250 | 600 | 150 + | 40 | 7 | acid: 3 | | | 5.5 |
| 3 | 180 | 600 | hydrochloric | 40 | 3 | hydrochloric | 50 | 10 | 1.1 |
| 4 | 200 | 600 | acid: 15 | 40 | 16 | acid: 50 | | | 15.2 |
| 5 | 200 | 600 | nitric acid: | 50 | 10 | hydrochloric | 50 | 10 | 14.4 |
| 6 | 200 | 600 | 150 + hydrochloric acid: 15 | 50 | 6 | acid: 10 + sulfuric acid: 50 | | | 7.8 |
| 7 | 200 | 600 | | 45 | 8 | hydrochloric | 50 | 10 | 8.8 |
| 8 | 210 | 600 | | 45 | 7 | acid: 5 + sulfuric acid: 5 | | | 7.5 |
| 9 | 210 | 600 | nitric acid: | 50 | 8 | sulfuric | 50 | 10 | 6.7 |
| 10 | 200 | 600 | 100 + | 50 | 9 | acid: 75 | | | 8.4 |
| 11 | 200 | 600 | hydrochloric | 55 | 8 | sulfuric | 50 | 10 | 9.0 |
| 12 | 200 | 600 | acid: 20 | 55 | 7 | acid: 150 | | | 7.1 |
| 13 | 200 | 600 | | 55 | 9 | | | | 10.9 |
| 14 | 200 | 1400 | | 55 | 9 | | | | 10.9 |
| 15 | 200 | 600 | | 40 | 12 | hydrochloric | 50 | 10 | 6.5 |
| 16 | 200 | 600 | | 40 | 14 | acid: 5 + | | | 8.6 |
| 17 | 200 | 600 | | 50 | 10 | sulfuric | 50 | 10 | 10.0 |
| 18 | 200 | 600 | | 50 | 12 | acid: 8 | | | 13.3 |
| 19 | 200 | 600 | nitric acid: | 45 | 10 | hydrochloric | 50 | 10 | 10.1 |
| 20 | 200 | 600 | 150 + | 45 | 12 | acid: 50 | | | 12.8 |
| 21 | 200 | 600 | hydrochloric acid: 20 | 40 | 4 | | | | 0.8 |
| 22 | 200 | 600 | nitric acid: | 50 | 10 | hydrochloric | 50 | 10 | 14.4 |

TABLE 3

| | | Hot-rolling process | | | Annealing process | | | | | |
|---|---|---|---|---|---|---|---|---|---|---|
| No. | Steel type | Slab heating temperature (° C.) | Finish rolling temperature (° C.) | Coilirg temperature (° C.) | Annealing temperature (° C.) | Holding time (sec) | Primary cooling average cooling rate (° C./sec) | Primary cooling stop temperature (° C.) | Secondary cooling average cooling rate (° C./sec) | Secondary cooling stop temperature (° C.) |
| 23 | E | 1250 | 900 | 580 | 830 | 600 | 10 | 560 | 902 | 24 |
| 24 | E | 1250 | 900 | 580 | 830 | 600 | 10 | 700 | 902 | 24 |
| 25 | E | 1250 | 900 | 580 | 830 | 600 | 10 | 700 | 902 | 24 |
| 26 | E | 1250 | 900 | 580 | 830 | 600 | 10 | 700 | 902 | 24 |
| 27 | E | 1250 | 900 | 580 | 830 | 600 | 10 | 700 | 902 | 24 |
| 28 | E | 1250 | 900 | 580 | 830 | 600 | 10 | 700 | 902 | 24 |

| | Overaging process | | Pickling conditions | | | Re-pickling conditions | | | Pickling |
|---|---|---|---|---|---|---|---|---|---|
| No. | Overaging temperature (° C.) | Holding time (sec) | Acid concentration (g/l) | Temperature (° C.) | Processing time (sec) | Acid concentration (g/l) | Temperature (° C.) | Processing time (sec) | weight loss (g/m$^2$) |
| 23 | 200 | 600 | 150 + hydrochloric acid: 15 | 50 | 10 | acid: 10 + sulfuric acid: 50 | | | 14.4 |
| 24 | 200 | 600 | — | — | — | — | — | — | 0.0 |
| 25 | 200 | 600 | nitric acid: 150 + hydrochloric acid: 15 | 60 | 20 | hydrochloric acid: 10 + sulfuric acid: 50 | 50 | 10 | 42.3 |
| 26 | 200 | 600 | | 50 | 10 | — | — | — | 14.4 |
| 27 | 200 | 600 | nitric acid: 150 + | 40 | 10 | hydrochloric acid: 10 | 40 | 30 | 8.7 |
| 28 | 200 | 600 | hydrochloric acid: 15 | 40 | 10 | hydrochloric acid: 10 | 70 | 1 | 9.0 |

* The conditions outside our range are shaded.

TABLE 4

| No. | Steel type | Ferrite volume fraction (%) | Martensite or bainite volume fraction (%) | Retained austenite volume reaction (%) | Rest of structure | Tensile strength (MPa) | Proportion of surface covered: Oxide mainly composed of Si (%) | Proportion of surface covered: Fe oxides (%) | $[Cu_S]/[Cu_B]$ | Chemical convertibility | Delayed fracture property | Remarks |
|---|---|---|---|---|---|---|---|---|---|---|---|---|
| 1 | A | 37 | 63 | — | — | 1222 | 0 | 30 | 3.9 | A | AA | Invention steel |
| 2 | B | 35 | 65 | — | — | 1635 | 0 | 29 | 3.7 | A | A | Invention steel |
| 3 | C | 30 | 70 | — | — | 1368 | 0 | 34 | 3.5 | A | AA | Invention steel |
| 4 | D | 28 | 72 | — | — | 1406 | 0 | 30 | 3.4 | A | A | Invention steel |
| 5 | E | 26 | 74 | — | — | 1425 | 0 | 25 | 3.6 | A | AA | Invention steel |
| 6 | F | 21 | 79 | — | — | 1539 | 0 | 34 | 3.2 | A | A | Invention steel |
| 7 | G | 33 | 67 | — | — | 1337 | 0 | 32 | 3.9 | A | AA | Invention steel |
| 8 | H | 48 | 52 | — | — | 1343 | 0 | 32 | 3.8 | A | AA | Invention steel |
| 9 | I | 21 | 79 | — | — | 1564 | 0 | 30 | 3.8 | A | A | Invention steel |
| 10 | J | 21 | 79 | — | — | 1501 | 0 | 36 | 3.9 | A | A | Invention steel |
| 11 | K | 23 | 77 | — | — | 1509 | 0 | 28 | 3.7 | A | A | Invention steel |
| 12 | L | 20 | 80 | — | — | 1570 | 0 | 36 | 3.6 | A | A | Invention steel |
| 13 | M | 25 | 75 | — | — | 1505 | 0 | 33 | 3.9 | A | A | Invention steel |
| 14 | N | 14 | 78 | 8 | — | 1487 | 0 | 32 | 3.7 | A | A | Invention steel |
| 15 | O | 46 | 54 | — | — | 1078 | 0 | 36 | 2.8 | A | AA | Comparative steel |
| 16 | P | 47 | 53 | — | — | 2015 | 0 | 26 | 3.8 | A | F | Comparative steel |
| 17 | Q | 26 | 74 | — | — | 1399 | 0 | 38 | 3.1 | A | F | Comparative steel |
| 18 | R | 38 | 62 | — | — | 1313 | 20 | 30 | 3.6 | F | A | Comparative steel |
| 19 | S | 80 | 20 | — | — | 981 | 0 | 28 | 3.3 | A | AA | Comparative steel |
| 20 | T | 35 | 65 | — | — | 1343 | 0 | 36 | 2.4 | A | F | Comparative steel |
| 21 | U | 32 | 68 | — | — | 1356 | 16 | 38 | 3.4 | F | AA | Comparative steel |
| 22 | E | 56 | 0 | — | Pearlite | 968 | 0 | 30 | 3.6 | A | AA | Comparative steel |
| 23 | E | 74 | 26 | — | — | 1077 | 0 | 35 | 3.6 | A | AA | Comparative steel |
| 24 | E | 32 | 68 | — | — | 1381 | 23 | 48 | 1.0 | F | AA | Comparative steel |
| 25 | E | 32 | 68 | — | — | 1381 | 0 | 0 | 8.8 | F | AA | Comparative steel |
| 26 | E | 32 | 68 | — | — | 1376 | 0 | 84 | 3.6 | F | AA | Comparative steel |
| 27 | E | 32 | 68 | — | — | 1378 | 0 | 30 | 1.9 | B | AA | Invention steel |
| 28 | E | 32 | 68 | — | — | 1380 | 0 | 60 | 4.2 | F | AA | Comparative steel |

* The conditions outside our range are shaded.

According to Tables 2 to 4, we confirmed that our steels that meet our conditions have a tensile strength of 1180 MPa or more, excellent chemical convertibility, and excellent delayed fracture resistance since the steels did not fracture for 40 hours.

Nos. 15 to 21 are examples in which the steel composition is outside our range.

No. 15 has a tensile strength lower than 1180 MPa because the C content is low.

No. 16 has coarse carbides and poor delayed fracture resistance since the C content is high.

No. 17 has coarse carbides and poor delayed fracture resistance since the Si content is low.

No. 18 has poor chemical convertibility since the Si content is high and the oxides mainly composed of Si on the steel sheet surface are not sufficiently removed by pickling. Since increasing the pickling weight loss causes the Cu concentration distribution in the surface layer to exceed the defined range, the chemical convertibility does not improve.

No. 19 has a large amount of ferrite precipitated and has a tensile strength lower than 1180 MPa because the Mn content is low.

No. 20 has poor delayed fracture resistance since the Cu content is low.

In No. 21, the pickling conditions for obtaining the desired Cu concentration distribution on the surface layer are difficult to control since the Cu content is high. In No. 21, although the conditions were controlled to reduce the pickling weight loss, the oxides mainly composed of Si were not sufficiently removed, and thus the chemical convertibility was poor.

Nos. 22 to 26 and 28 are examples in which the manufacturing methods are outside our recommended range. Thus, at least one of the tensile strength, the proportion of the steel sheet surface covered, and $Cu_S/Cu_B$ is outside our range.

No. 22 has a tensile strength lower than 1180 MPa because the annealing temperature is low and austenite is not generated.

No. 23 has an excessive amount of ferrite precipitated and has a tensile strength lower than 1180 MPa because the primary cooling stop temperature is low.

No. 24 is an example in which pickling was not performed after continuous annealing, and has poor chemical convertibility since the oxides mainly composed of Si remain on the steel sheet surface.

No. 25 has poor chemical convertibility since the pickling weight loss was increased and our Cu concentration distribution on the surface layer was not obtained.

No. 26 is an example in which re-pickling after pickling was omitted, and has poor chemical convertibility since Fe oxides remain on the steel sheet surface.

No. 28 has poor chemical convertibility since the pickling solution temperature for re-pickling exceeds the upper limit of our preferred range, and our Cu concentration distribution on the surface layer defined.

The invention claimed is:

1. A high-strength cold-rolled steel sheet comprising:

a composition that contains, in terms of mass %,

C: 0.10% or more and 0.50% or less,

Si: 1.0% or more and 3.0% or less,

Mn: 1.0% or more and 2.5% or less,

P: 0.05% or less,

S: 0.02% or less,

Al: 0.01% or more and 1.5% or less,

N: 0.005% or less,

Cu: 0.05% or more and 0.50% or less,

Cr: 1.0% or less, and the balance being Fe and unavoidable impurities, wherein a proportion of a steel sheet surface covered with oxides mainly composed of Si is 1% or less, a proportion of the steel sheet surface covered with Fe oxides is 40% or less, $Cu_S/Cu_B$ is 2.0 to 4.0, and a tensile strength is 1180 MPa or more, where $Cu_S$ denotes a Cu content in a steel sheet surface layer and $Cu_B$ denotes a Cu content in a base material.

2. The high-strength cold-rolled steel sheet according to claim 1, further comprising a steel sheet structure containing 40% or more and 100% or less of at least one selected from martensite and bainite in terms of volume fraction, 0% or more and 60% or less of ferrite in terms of volume fraction, and 0% or more and 20% or less of retained austenite.

3. The high-strength cold-rolled steel sheet according to claim 1, wherein [Si]/[Mn]>0.4, [Si] denotes a Si content (mass %) and [Mn] denotes a Mn content (mass %).

4. The high-strength cold-rolled steel sheet according to claim 2, wherein [Si]/[Mn]>0.4, [Si] denotes a Si content (mass %) and [Mn] denotes a Mn content (mass %).

5. The high-strength cold-rolled steel sheet according to claim 1, wherein the composition further contains, in terms of mass %, at least one selected from Nb: 0.2% or less, Ti: 0.2% or less, V: 0.5% or less, Mo: 0.3% or less, and B: 0.005% or less.

6. The high-strength cold-rolled steel sheet according to claim 2, wherein the composition further contains, in terms of mass %, at least one selected from Nb: 0.2% or less, Ti: 0.2% or less, V: 0.5% or less, Mo: 0.3% or less, and B: 0.005% or less.

7. The high-strength cold-rolled steel sheet according to claim 3, wherein the composition further contains, in terms of mass %, at least one selected from Nb: 0.2% or less, Ti: 0.2% or less, V: 0.5% or less, Mo: 0.3% or less, and B: 0.005% or less.

8. The high-strength cold-rolled steel sheet according to claim 4, wherein the composition further contains, in terms of mass %, at least one selected from Nb: 0.2% or less, Ti: 0.2% or less, V: 0.5% or less, Mo: 0.3% or less, and B: 0.005% or less.

9. The high-strength cold-rolled steel sheet according to claim 1, wherein the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

10. The high-strength cold-rolled steel sheet according to claim 2, wherein the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

11. The high-strength cold-rolled steel sheet according to claim 3, wherein the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

12. The high-strength cold-rolled steel sheet according to claim 4, wherein the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

13. The high-strength cold-rolled steel sheet according to claim 5, wherein the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

14. The high-strength cold-rolled steel sheet according to claim 6, wherein the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

15. The high-strength cold-rolled steel sheet according to claim 7, wherein the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

16. The high-strength cold-rolled steel sheet according to claim 8, wherein the composition further contains, in terms of mass %, at least one selected from Sn: 0.1% or less, Sb: 0.1% or less, W: 0.1% or less, Co: 0.1% or less, Ca: 0.005% or less, and REM: 0.005% or less.

17. The high-strength cold-rolled steel sheet according to claim 1, the Cu content is 0.11% to 0.45% and the Si content is 1.2 to 2.0%.

* * * * *